United States Patent [19]

Meyer

[11] Patent Number: 4,845,788

[45] Date of Patent: Jul. 11, 1989

[54] WATER FILLABLE MATTRESS WITH COVER

[76] Inventor: Jeannette L. Meyer, 7251 Hickory Ave., Orangevale, Calif. 95662

[21] Appl. No.: 27,688

[22] Filed: Jul. 13, 1987

[51] Int. Cl.[4] ..... A47C 27/08

[52] U.S. Cl. ..... 5/451; 5/424; 5/422

[58] Field of Search ..... 5/422, 451, 453, 455, 5/424, 452, 449, 482

[56] References Cited

U.S. PATENT DOCUMENTS

| | | | |
|---|---|---|---|
| 95,848 | 10/1969 | Somes | 5/422 |
| 773,828 | 11/1907 | Titus et al. | 5/451 |
| 4,149,541 | 4/1979 | Gammons et al. | 5/455 |
| 4,266,307 | 5/1981 | Critelli | 5/451 |
| 4,281,425 | 8/1981 | Jacobs | 5/451 |
| 4,517,692 | 5/1985 | Vogel | 5/451 |

*Primary Examiner*—Alexander Grosz

[57] ABSTRACT

A water fillable mattress, with a support, has water circulating passages and an inflatable cover, releasably attachable to one side of the mattress, and permanently attached to another side of the mattress. The mattress is sized to support a child and is adapted to relieve the fever of the child when cold water is circulated through its passages.

1 Claim, 1 Drawing Sheet

WATER FILLABLE MATTRESS WITH COVER

SUMMARY OF THE INVENTION

This invention relates to a mattress that is adapted to support a child who has a fever, and helps reduce the fever by permitting the circulation of cooling water through the passages of the mattress. The mattress is provided with an inflatable cover, which when positioned on a child supported by the mattress, will prevent the child from moving around, or getting off the mattress. The mattress may also be used in a burn center to induce the healing of a burn victim. The mattress is provided with a support that comprises a flat sheet that has an air filled tube around its perimeter.

DESCRIPTION OF THE PREFERRED EMBODIMENT

Figure 1:
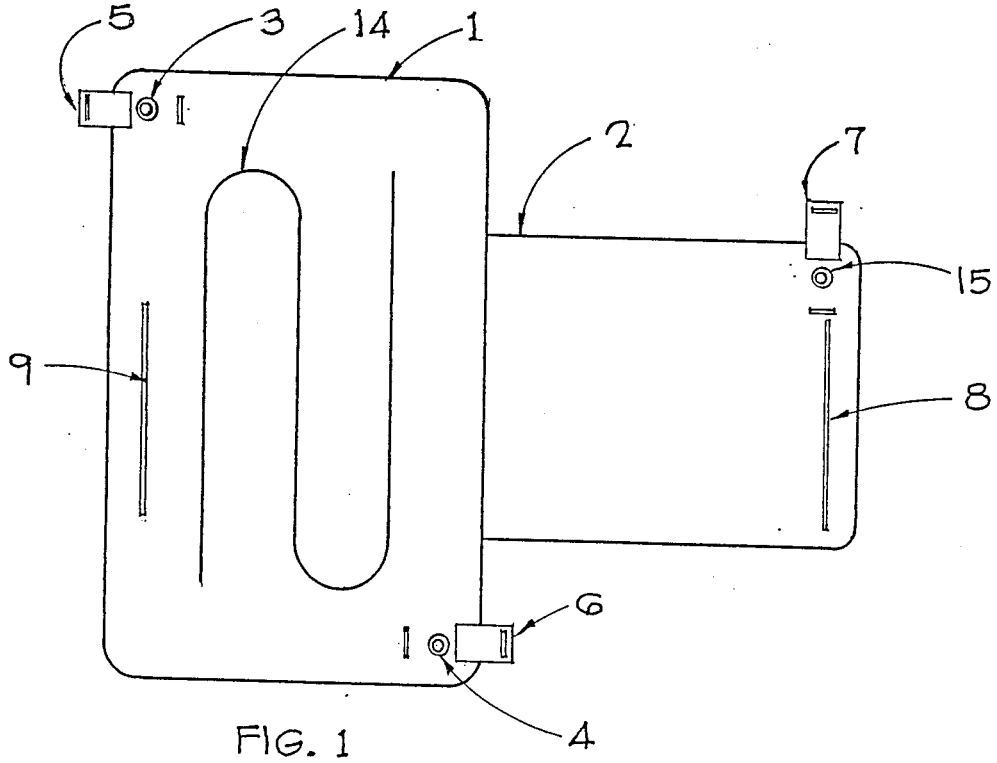
FIG. 1 is a schematic top view of the mattress of the invention, with the cover portion in the unattached condition.
Figure 2:
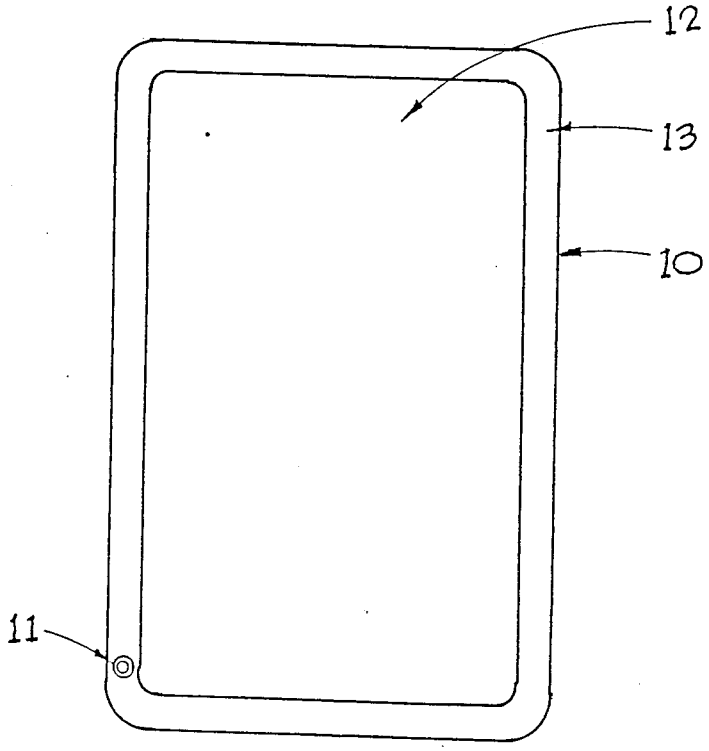
FIG. 2 is a schematic top view of the support portion prior to the positioning of the mattress on it.

FIG. 1 shows a generally rectangular mattress portion 1, and a generally rectangular cover or flap portion 2, that is permanently attached to one side of the mattress portion. The mattress is made from rubberized crib sheeting and is comprised of an upper and a lower sheet, connected at their perimeters. The sheets are sealed to each other at central locations by seams 14, to define tunnels or passages between the upper and the lower sheet. A standard water inlet port or valve 3, and a water port or outlet 4 is provided on the mattress portion to permit entry and exit of water. The cover portion 2 is made from rubberized crib sheeting, is inflatable, and has a standard air valve 15 that permits the inflating of the cover with air. The water inlet valve has a covering flap 5, the water outlet valve has a covering flap 6, and the air valve 15 has a covering flap 7. The cover and mattress portion are provided with mating hook and loop type fastener 8 and 9, such as the ones sold under the trademark of VELCRO, which permit the releasable securing of the free edge of the cover to the edge of the mattress portion opposite to the one which has the cover permanently attached to it. The covering flaps 4, 5 and 6 are also provided with hook and loop type fastener means that permit the covering of the valves. FIG. 2 shows a support 10 for the mattress with cover that is comprised of a flat sheet 12 with an air filled tube 13 around its perimeter. The tube 13 may be filled through a conventional valve 11. The sheet 12 and tube 13 define a cavity portion in which the mattress 1 is supported.

What is claimed is:

1. A device adapted to relieve the fever of a child comprising a water fillable mattress of sufficient size to support a child, said mattress comprising two sealed together sheets defining passages through which cooling water can flow, entering the water mattress at a water inlet port and exiting at a water outlet port, said ports provided with port covering flap portions, a large user covering inflatable flap permanently attached to one side of the mattress and adapted to be releasably attached to another side of the mattress by releasable fastener means, said flap being of a size to cover about two thirds of the mattress, to thereby prevent a user of the mattress from rolling off the mattress, said device further including a support for the mattress with flap, said support comprising a flat sheet with an air filled tube around its perimeter.

* * * * *